US009804616B2

(12) United States Patent
Michal

(10) Patent No.: US 9,804,616 B2
(45) Date of Patent: Oct. 31, 2017

(54) SINGLE-SHOT DUTY CYCLE GENERATOR FOR A SWITCHED-MODE POWER SUPPLY

(71) Applicant: STMicroelectronics (Grenoble 2) SAS, Grenoble (FR)

(72) Inventor: Vratislav Michal, Grenoble (FR)

(73) Assignee: STMicroelectronics (Grenoble 2) SAS, Grenoble (FR)

( * ) Notice: Subject to any disclaimer, the term of this patent is extended or adjusted under 35 U.S.C. 154(b) by 90 days.

(21) Appl. No.: 14/616,413

(22) Filed: Feb. 6, 2015

(65) Prior Publication Data

US 2016/0231760 A1 Aug. 11, 2016

(51) Int. Cl.
*G05F 1/56* (2006.01)
*G05F 1/563* (2006.01)
*G05F 1/565* (2006.01)

(52) U.S. Cl.
CPC ..... *G05F 1/56* (2013.01); *G05F 1/563* (2013.01); *G05F 1/565* (2013.01)

(58) Field of Classification Search
CPC ..... H02M 1/143; G05F 1/56
USPC ..... 323/280
See application file for complete search history.

(56) References Cited

U.S. PATENT DOCUMENTS 6,563,378 B1 * 5/2003 Kirn ..... H03F 3/2171 330/10
8,264,258 B1 * 9/2012 Chen ..... H03L 7/1075 327/147
2010/0096926 A1 * 4/2010 King ..... B60L 11/123 307/45
2010/0097829 A1 * 4/2010 Uno ..... H02M 1/4225 363/124
2014/0266475 A1 * 9/2014 Hinrichs ..... H03K 3/0315 331/57

FOREIGN PATENT DOCUMENTS

EP 2 736 156 A1 5/2014
EP 2 819 288 A1 12/2014

OTHER PUBLICATIONS

Michal, V., "On the Low-power Design, Stability Improvement and Frequency Estimation of the CMOS Ring Oscillator," 22nd International Conference Radioelektronika, 4 pgs., Apr. 17-18, 2012.
Zhang, J. et al., "An Analog CMOS Double-Edge Multi-Phase Low-Latency Pulse Width Modulator," Twenty Second Annual IEEE Applied Power Electronics Conference (APEC 2007), Anaheim, CA, USA, pp. 355-360, Feb. 25-Mar. 1, 2007.

* cited by examiner

*Primary Examiner* — Jue Zhang
*Assistant Examiner* — Trinh Dang
(74) *Attorney, Agent, or Firm* — Seed IP Law Group LLP

(57) ABSTRACT

A switched-mode power supply device includes a power switch configured to transfer power from a supply line to a load in switched-mode; a first oscillator configured to operate at a frequency proportional to a voltage of the supply line; a second oscillator configured to operate at a frequency proportional to a voltage of the load; and a regulator configured to operate the power switch according to a duty cycle based on a ratio between the first and second oscillator frequencies.

11 Claims, 2 Drawing Sheets

SINGLE-SHOT DUTY CYCLE GENERATOR FOR A SWITCHED-MODE POWER SUPPLY

BACKGROUND

Technical Field

The present disclosure relates to switched-mode power supplies (SMPS), and more specifically to the generation of a duty cycle for controlling a power switch of the SMPS.

Description of the Related Art

FIG. 1 is a block diagram of an exemplary buck SMPS. It comprises an inductor L connected in series between a load RL and a high-side switch SWH. The switch SWH is further connected to a supply line Vdd, and the load RL is further connected to a ground line Vss. A filter capacitor C is connected in parallel with the load RL. A low-side switch SWL couples the high-side switch SWH to line Vss.

As shown, the switches SWH and SWL may be N-MOS transistors driven independently by respective signals HI, LO. The signals HI, LO are produced by a driver circuit 10 based on a pulse-width modulation signal (PWM) generated by a circuit 12. Circuit 12 may generate the PWM signal from a clock signal CK and a control voltage Vctrl.

The driver circuit 10 is usually configured to drive transistors SWH and SWL in phase opposition. In simpler SMPS devices, the low-side transistor SWL may be replaced by a freewheel diode.

FIG. 2A is a simplified circuit diagram of an exemplary PWM circuit 12. A ramp generator includes a capacitor Cr charged from the line Vdd through a constant current source Ir. The clock signal CK drives a switch SWr to periodically discharge the capacitor Cr. In this configuration, the clock signal CK is applied to the switch SWr in the form of short pulses that are sufficiently wide to cause a full discharge of the capacitor Cr.

The ramp voltage Vr is taken from the node between the current source Ir and the capacitor Cr. The voltage Vr is applied to an inverting input of a comparator 14. The non-inverting input of the comparator receives the control voltage Vctrl. The output of the comparator produces the PWM signal with a duty-cycle set by the control voltage Vctrl.

FIG. 2B illustrates an exemplary evolution of signals CK, Vr and PWM for a linearly rising voltage Vctrl. As voltage Vctrl increases, the duty-cycle of signal PWM increases proportionally. The ramp Vr reaches a peak voltage Vpk equal to Ir·Tck/Cr (assuming that the fall time of the ramp is negligible), where Tck is the period of clock CK. Voltage Vpk thus defines the variation range of voltage Vctrl for producing a duty cycle between 0 and 100%. In practice, duty cycles of 0% and 100% are not reached.

The SMPS structure of FIG. 1 may be used in a control loop for regulating the voltage VL across the load RL. Then, as shown, the control voltage Vctrl may be produced as an error voltage based on the difference between the load voltage VL and a target value Vref. In a stable operation of the regulated SMPS, the duty-cycle assumes an average value of Ton/Tck=VL/Vdd (assuming that the voltage drops in the transistors and inductor are negligible), where Ton is the conduction time of the high-side transistor SWH within each clock period Tck.

When the power consumed by the load RL decreases below a threshold, the SMPS enters a discontinuous operating mode, where the current IL in the inductor L reaches zero. Such an operation mode may cause difficulties in maintaining good energy efficiency.

BRIEF SUMMARY

One embodiment of the present disclosure is a switched-mode power supply device that includes:

a power switch configured to transfer power from a supply line to a load in switched-mode;

a first oscillator configured to operate at a frequency proportional to a voltage of the supply line;

a second oscillator configured to operate at a frequency proportional to a voltage of the load; and a regulator configured to operate the power switch according to a duty cycle based on a ratio between the first and second oscillator frequencies.

One embodiment of the present disclosure is a device that includes:

a first oscillator configured to operate at a frequency proportional to a first voltage;

a first counter configured to count cycles of the first oscillator;

a second oscillator configured to operate at a frequency proportional to a second voltage smaller than the first voltage;

a second counter configured to count cycles of the second oscillator;

a clock circuit configured to reset the first and second counters at clock cycle transitions;

a latch configured to store content of the second counter at clock cycle transitions; and a comparator configured to enable an output signal while content of the first counter is smaller than the content of the latch.

DETAILED DESCRIPTION

Figure 1:
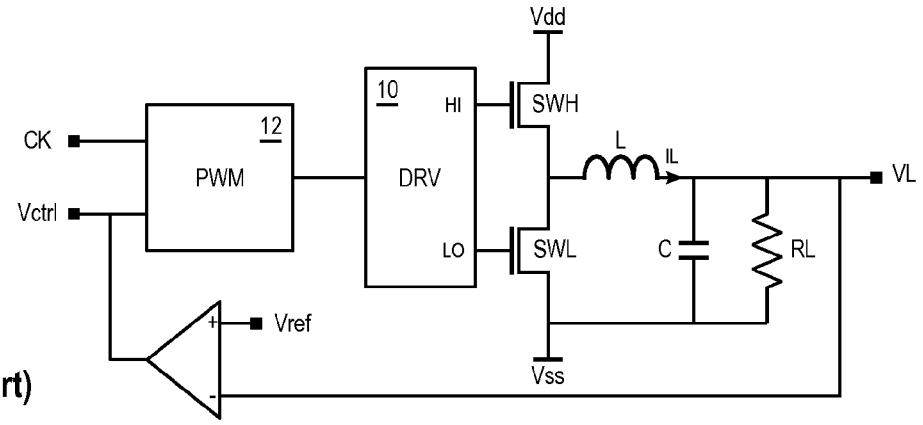
Fig 1 (prior art)
FIG. 1 is a block diagram of a conventional buck SMPS.
Figure 3:
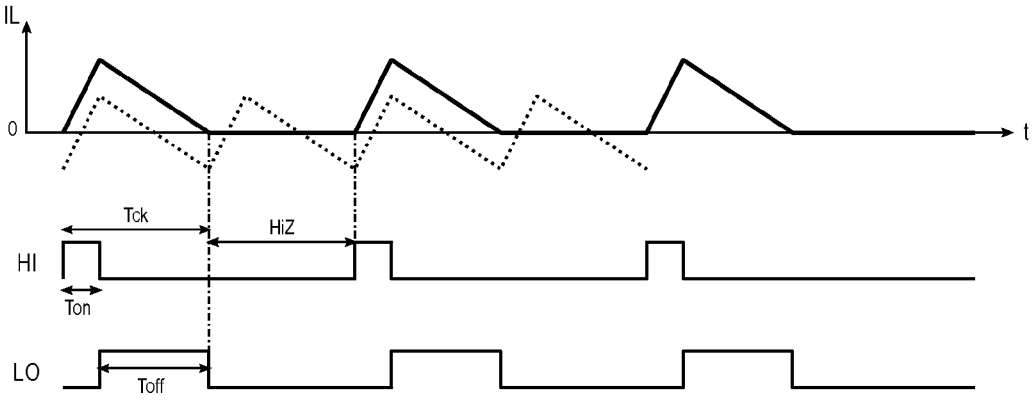
FIG. 3 is a time diagram illustrating a pulse-skipping operation mode of an SMPS.

FIG. 3 is a time diagram illustrating an exemplary operation of the buck SMPS of FIG. 1 when it enters in a discontinuous mode. In continuous mode, the current IL is a substantially triangular wave having all points above zero. The rising portions of the current correspond to the conduction phases (Ton) of the transistor SWH (transistor SWL being off), and the decreasing portions of the current correspond to the off phases of the transistor SWH (transistor SWL then being on). When the power delivered to the load decreases, the triangular wave descends and ends up by crossing the zero current level, as shown in dotted lines, where the SMPS enters in discontinuous mode.

An operation as illustrated by the dotted lines is not desirable. Indeed, when the current IL becomes negative, power is drawn from the load and the filter capacitor C through transistor SWL, which reduces efficiency. It is preferred to open switch SWL when the current IL reaches zero, so that no power is drawn from the load during this phase—the negative portions of the dotted triangular wave become flat at zero. Such an operation however relies upon an accurate zero-crossing detector to turn off transistor SWL when the current IL reaches zero. Indeed, turning off the transistor SWL when the inductor current has not precisely reached zero may cause spurious voltage spikes, oscillation and efficiency losses. A zero-crossing detector is an analog circuit that may be complex and power demanding for achieving satisfactory accuracy.

The triangular wave in bold lines illustrates an operating mode that can be achieved without zero-crossing detection. The regulator system is configured so that the current cancels exactly at the end of each clock period, and therefore does not become negative. This operation mode may provide more power to the load than actually required, which is why it is typically combined with a "pulse-skipping" regulation scheme.

As shown in the diagram by way of example, every second pulse is skipped, i.e. every second period of the triangular wave remains at zero, whereby the power transmitted to the load is halved in average. The corresponding driving signals, HI and LO, of the transistors SWH and SWL are shown. The power provided to the load may be adjusted in average by skipping more or less pulses.

In each clock period where a pulse is skipped, both transistors SWH and SWL remain off, i.e. the drive signals HI and LO remain inactive. The SMPS power stage is then in a high impedance mode (HiZ) that does not draw power from the load.

To make the inductor current cancellations coincide with the clock period transitions, the duty-cycle Ton/Tck is set to track VL/Vdd, where voltage values VL and Vdd may in fact vary. Indeed, the inductor current rises by (Vdd−VL)·Ton/L during the on-phase of transistor SWH, and falls by VL·Toff/L during the off-phase of transistor SWH (the on-phase of transistor SWL), assuming that the voltage drop through each transistor is negligible. In steady state, both values are equal, yielding $$\frac{Ton}{Tclk} = \frac{VL}{Vdd}. \tag{1}$$

Figure 2A:
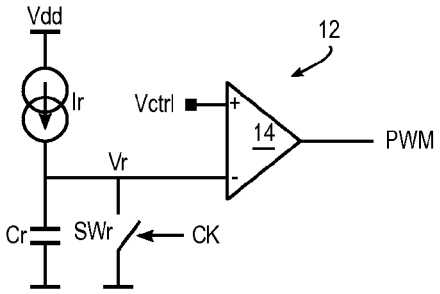
Fig 2A (prior art)
FIG. 2A is a simplified diagram of an exemplary pulse-width generator circuit usable in the SMPS of FIG. 1.
Figure 2B:
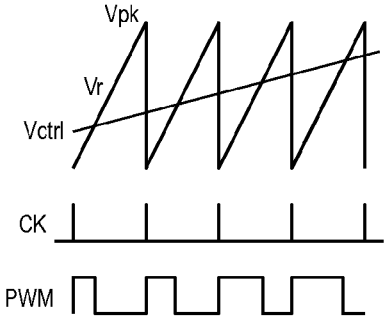
Fig 2B (prior art)
FIG. 2B is a time diagram illustrating the operation of the circuit of FIG. 2A.

Such tracking may be obtained by providing the load voltage VL (or k·VL) as the control voltage Vctrl of the pulse-width modulator 12 FIG. 2A), while ensuring that the ramp peak voltage Vpk (FIG. 2B) is equal to Vdd (or k·Vdd, where k is a constant factor). The target voltage Vref (FIG. 1) may be used instead of voltage VL, since voltages VL and Vref are designed to be equal in steady state operation in the example of FIG. 1. In fact, it may be preferred to use voltage Vref, independent by design, because using voltage VL may introduce an undesired feed-forward loop.

Although the load voltage VL is directly usable by the circuit 12, the ramp peak voltage Vpk does not depend on Vdd but on the current source Ir, the capacitor Cr, and the clock period Tck. Although the current source may be configured to track the voltage Vdd such that Ir=g·Vdd, both the transconductance g and the value of capacitor Cr vary with temperature and process, usually resulting in calibrations and process-dependent analog adjustment circuitry.

Figure 4:
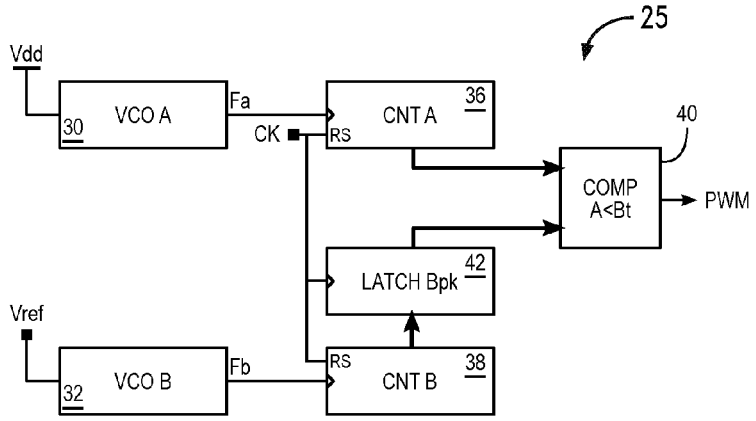
FIG. 4 is a block diagram of an embodiment of a single-shot duty-cycle generator according to the invention for an SMPS operating in discontinuous or pulse-skipping mode.

FIG. 4 is a block diagram of an embodiment of a single-shot duty-cycle generator 25 that is insensitive to temperature and process variations, and does not require calibration. By "single-shot" it is understood that the generator establishes a final duty-cycle value (equation 1) during each clock cycle for the next clock cycle. The generator uses no feedback nor calibration loop that may introduce instability and have a settling time over several clock cycles.

The duty-cycle generator is based on two voltage-controlled oscillators, the first 30 being controlled by the supply voltage Vdd, and the second 32 being controlled by the actual load voltage VL or rather its target value Vref. The oscillators may have the same structure and be fabricated on the same semiconductor die, so that they have matching voltage-to-frequency responses. The average operating frequency of the oscillators is adjusted a factor of several tens greater than the SMPS clock frequency CK.

The outputs Fa, Fb of oscillators 30, 32 drive two respective counters 36 and 38. The counters are reset at the transition of each clock cycle by signal CK, whereby each counter reaches a value proportional to the corresponding oscillator frequency at the end of each clock cycle.

The content A of the counter 36 is provided to a digital comparator 40. The content B of the counter 38 is provided to a latch 42 that is enabled at the transition of each clock cycle by signal CK. The content Bt of latch 42 is provided as a threshold to a second input of comparator 40. The comparator is configured to set a pulse-width modulation signal PWM high as long as count A is smaller than the threshold Bt. When the count A exceeds the threshold Bt, the comparator sets the PWM signal low.

Figure 5:
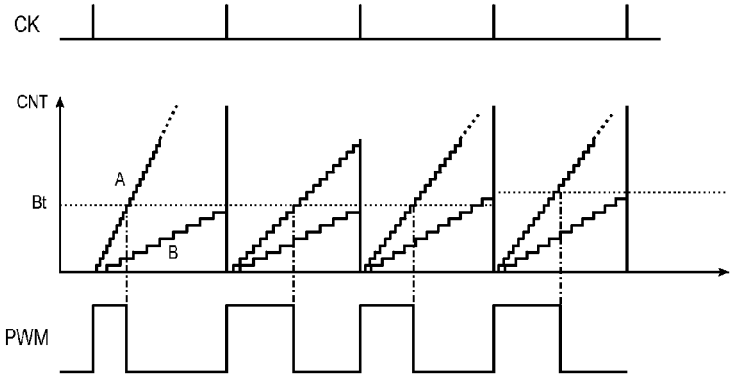
FIG. 5 is a time diagram illustrating the operation of the circuit of FIG. 4.

FIG. 5 is a time diagram illustrating an exemplary operation of the circuit of FIG. 4. The clock signal CK is shown in the form of periodic short duration pulses, as used in circuit 12 to reset the ramp. The same pulses may be used to reset the counters and enable the latch 42. The time diagram further shows exemplary evolutions of the contents A and B of the counters 30, 32, and the corresponding PWM signal produced by the comparator 40.

At the first clock pulse, both counters are reset and start counting at the rate of the respective oscillator frequencies. The latch stores the threshold Bt reached by count B at the end of the previous clock cycle, for example the value 10. As shown, count A, representing voltage Vdd, increases faster than count B, representing voltage Vref. Signal PWM is high until count A reaches the threshold Bt=10, which happens here at a quarter of the clock period. At the end of the clock period, count B reaches 10, whereby value Bt remains unchanged for the next clock period, meaning that the voltage Vref has not changed.

The second clock pulse starts a new clock period by resetting the counters and storing 10 as threshold Bt in the latch. The voltage Vdd has decreased, causing a slower progression of count A. Value Bt=10 is reached in the middle of the cycle. The PWM signal is thus high during the first half of the clock period.

At the third clock pulse, count B has reached value 10 again, meaning that the voltage Vref remained constant. Both counts A and B progress faster than during the previous cycle, meaning that both voltages Vdd and Vref have increased. Count A reaches value Bt=10 at 0.4·Tck.

At the fourth clock pulse, count B reaches 12. This new value is latched as threshold Bt. The voltage Vdd has not changed, whereby count A progresses at the same speed as during the previous clock cycle. Count A reaches value Bt=12 in the middle of the clock cycle.

Figure 6:
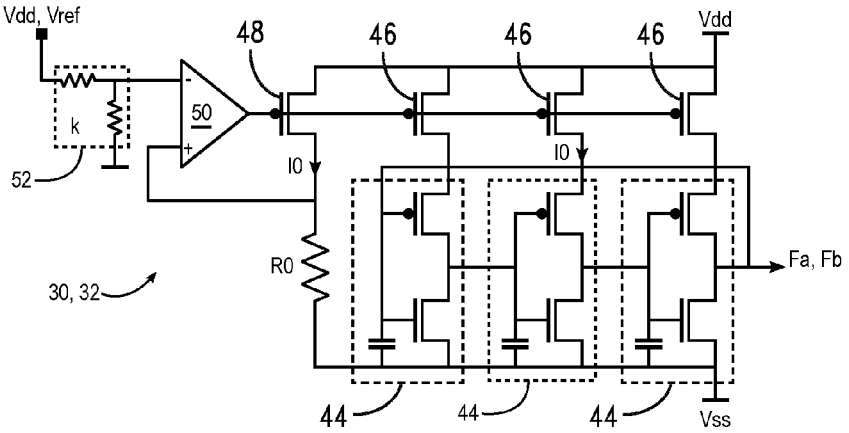
FIG. 6 is a circuit diagram of an exemplary controlled oscillator usable in the circuit of FIG. 4.

FIG. 6 is a circuit diagram of an exemplary oscillator structure, common to both oscillators 30, 32, that may be designed to offer a linearly proportional voltage-to-frequency response. The oscillator comprises an odd number of CMOS inverters 44, here three, connected in a ring. Each inverter 44 is supplied from line Vdd by a controlled current source in the form of a P-MOS transistor 46. The P-MOS transistors 46 are connected in parallel in a current mirror configuration to copy the current from a common P-MOS transistor 48.

The transistor 48 is connected in a voltage-follower configuration with an operational amplifier 50. The gate of transistor 48 is controlled by the output of amplifier 50. The source of transistor 48 is connected to line Vdd, and the drain of the transistor is fed back to the non-inverting input of the amplifier 50. The inverting input of the amplifier 50 receives the corresponding voltage to follow, Vdd or VL, for instance attenuated by a factor k through a divider bridge 52. With this configuration, the amplifier 50 controls the transistor 48 so that its drain voltage equals the voltage at the inverting input of the amplifier. This voltage, k·Vdd or k·Vref, is applied to a resistor R0 connected to line Vss. The resistor R0 thus draws a current I0 equal to k·Vdd/R0 or k·Vref/R0 through transistor 48, which current is replicated in transistors 46 and thus applied to each inverter 44.

The ring oscillator frequency depends on current I0 and the input capacitances of the inverters. If the average frequency of the oscillator is too high, the input capacitances may be increased, as shown, by connecting an extra capacitor to each inverter input, or by increasing the number of inverters in the ring.

Although the absolute frequency value achieved by each oscillator is temperature and process dependent due to the use of capacitors and resistors, the capacitors and the resistors can be readily designed on a same semiconductor die so that their values accurately match between the two oscillators. The oscillators will thus have matched voltage-to-frequency responses that vary in the same manner with temperature and process variations. The ratio of the frequencies thus cancels the variations, producing a single-shot duty-cycle of Ton/Tck that is temperature and process independent.

Various modifications and alternatives of the above-disclosed embodiments will appear to those skilled in the art. A regulation loop was exemplified where the output load voltage VL is compared directly to a target value Vref—in applications where the voltage VL exceeds the operating range of the regulator circuit, voltage VL may be first attenuated by a factor N before it is compared to voltage Vref. If voltage Vref is still used for controlling the oscillator 32, the voltage Vdd would be applied with the attenuation factor N to oscillator 30.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A switched-mode power supply device comprising:

a power switch configured to transfer power from a supply line to a load in switched-mode; and a duty cycle generator that includes:

a first oscillator configured to operate at a frequency proportional to a voltage of the supply line; and a second oscillator configured to operate at a frequency proportional to a voltage of the load; wherein:

the duty cycle generator is configured to operate the power switch according to a duty cycle based on a ratio between the first and second oscillator frequencies.

2. The device of claim 1, wherein the first and second oscillators have respective voltage-to-frequency responses that match each other.

3. The device of claim 1, wherein the duty cycle generator includes:

a first counter configured to count cycles of the first oscillator;

a second counter configured to count cycles of the second oscillator;

a clock configured to reset the first and second counters at each clock cycle transition;

a latch configured to store content of the second counter at each clock cycle transition; and a comparator configured to turn the power switch on while content of the first counter is smaller than the content of the latch.

4. The device of claim 1, wherein:

the first oscillator comprises:

an odd number of first inverters connected in a first ring;

a first plurality of current sources respectively configured to supply the first inverters; and a first adjustment circuit configured to set a current of each current source of the first oscillator to a value proportional to the voltage of the supply line; and the second oscillator comprises:

an odd number of second inverters connected in a second ring;

a second plurality of current sources respectively configured to supply the second inverters; and a second adjustment circuit configured to set a current of each current source of the second oscillator to a value proportional to the voltage of the load.

5. A device comprising:

a first oscillator configured to operate at a frequency proportional to a first voltage;

a first counter configured to count cycles of the first oscillator;

a second oscillator configured to operate at a frequency proportional to a second voltage smaller than the first voltage;

a second counter configured to count cycles of the second oscillator;

a clock circuit configured to reset the first and second counters at clock cycle transitions;

a latch configured to store content of the second counter at clock cycle transitions; and a comparator configured to enable an output signal while content of the first counter is smaller than the content of the latch.

6. The device of claim 5, wherein the first and second oscillators have respective voltage-to-frequency responses that match each other.

7. The device of claim 5, wherein:

the first oscillator comprises:

an odd number of first inverters connected in a first ring;

a first plurality of current sources respectively configured to supply the first inverters; and a first adjustment circuit configured to set a current of each current source of the first oscillator to a value proportional to the voltage of the supply line; and the second oscillator comprises:

an odd number of second inverters connected in a second ring;

a second plurality of current sources respectively configured to supply the second inverters; and a second adjustment circuit configured to set a current of each current source of the second oscillator to a value proportional to the voltage of the load.

8. A switched-mode power supply comprising:

an inductor configured to supply a load; and a switched-mode power supply device configured to drive the inductor, the switched-mode power supply device including:

a power switch configured to transfer power from a supply line to the load in switched-mode; and a duty cycle generator that includes:

a first oscillator configured to operate at a frequency proportional to a voltage of the supply line;

a second oscillator configured to operate at a frequency proportional to a voltage of the load; wherein:

the duty cycle generator is configured to operate the power switch according to a duty cycle based on a ratio between the first and second oscillator frequencies.

9. The switched-mode power supply of claim 8, wherein the first and second oscillators have respective voltage-to-frequency responses that match each other.

10. The switched-mode power supply of claim 8, wherein duty cycle generator includes:

a first counter configured to count cycles of the first oscillator;

a second counter configured to count cycles of the second oscillator;

a clock configured to reset the first and second counters at each clock cycle transition;

a latch configured to store content of the second counter at each clock cycle transition; and a comparator configured to turn the power switch on while content of the first counter is smaller than the content of the latch.

11. The switched-mode power supply of claim 8, wherein:

the first oscillator comprises:

an odd number of first inverters connected in a first ring;

a first plurality of current sources respectively configured to supply the first inverters; and a first adjustment circuit configured to set a current of each current source of the first oscillator to a value proportional to the voltage of the supply line; and the second oscillator comprises:

an odd number of second inverters connected in a second ring;

a second plurality of current sources respectively configured to supply the second inverters; and a second adjustment circuit configured to set a current of each current source of the second oscillator to a value proportional to the voltage of the load.

* * * * *